United States Patent [19]

Speigel

[11] 4,163,919

[45] Aug. 7, 1979

[54] CATHODE RAY TUBE INTERNAL RESISTIVE COATING AND METHOD OF MANUFACTURE

[75] Inventor: Kenneth Speigel, Seneca Falls, N.Y.

[73] Assignee: GTE Sylvania Incorporated, Stamford, Conn.

[21] Appl. No.: 903,427

[22] Filed: May 8, 1978

[51] Int. Cl.[2] ..... H01J 31/08; H01B 1/08

[52] U.S. Cl. ..... 313/479; 252/506; 252/510; 252/519

[58] Field of Search ..... 252/506, 510, 519; 313/450, 479, 480

[56] References Cited

U.S. PATENT DOCUMENTS

| | | | |
|---|---|---|---|
| 3,791,546 | 2/1974 | Maley et al. | 220/2.1 A |
| 4,041,347 | 8/1977 | Deal et al. | 252/506 X |

*Primary Examiner*—Benjamin R. Padgett
*Assistant Examiner*—E. Suzanne Parr
*Attorney, Agent, or Firm*—Thomas H. Buffton

[57] ABSTRACT

An internal resistive coating for a cathode ray tube is derived from a suspension which includes electrically conductive particles, electrically insulative particles, silicate solids and a wetting agent of the anionic class. The internal resistive coating is made by mixing the insulative particles, a silicate solution and water, milling the mixture, adding electrically conductive particles to the mixture, milling the electrically conductive particles and mixture to provide a suspension, preparing a stock solution of wetting agent of the anionic class, and stirring the wetting agent stock solution into the suspension to provide a wall dispersed resistive coating suspension.

6 Claims, 1 Drawing Figure

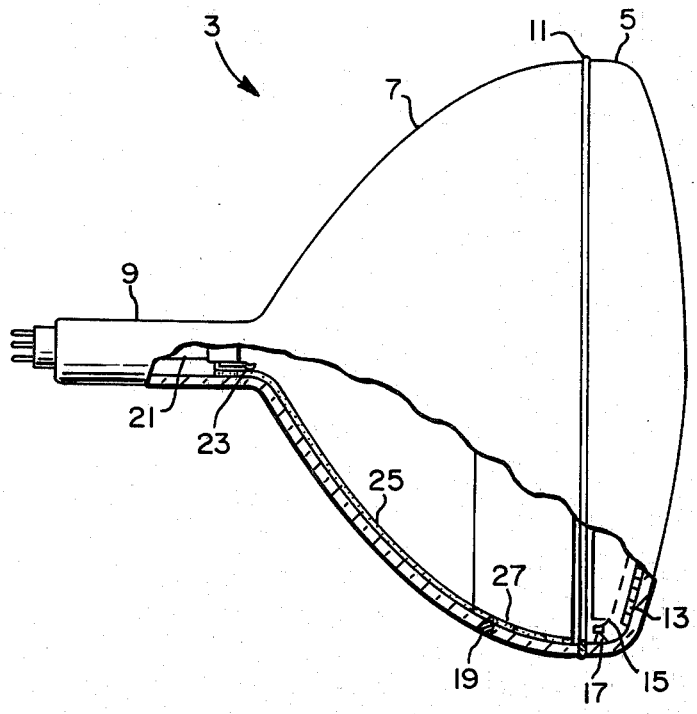
3
11
5
7
9
21
23
25
27
13
19
17
15

CATHODE RAY TUBE INTERNAL RESISTIVE COATING AND METHOD OF MANUFACTURE

BACKGROUND OF THE INVENTION

This invention relates to an internal resistive (or conductive) coating for a cathode ray tube and a method of making the coating. More particularly, the invention relates to an internal coating derived from a suspension consisting essentially of conductive and insulative particles, silicate solids, water and a wetting agent of the anionic class.

It is a common practice in present-day cathode ray tube manufacture to provide an internal resistive coating intermediate an anode button on the funnel portion and a snubber affixed to a mount assembly sealed into the neck portion of a cathode ray tube envelope. This internal resistive coating is employed to dissipate undesired arc currents which frequently occur due to the relatively high potentials and closely spaced components within the envelope. Thus, dissipation of undesired arc currents at the source or within the cathode ray tube tends to inhibit the undesired application thereof to associated semi-conductor components which are prone to catastrophic failure when subjected to such stresses.

In addition to this arc-limiting capability, there is a similar group of coatings having conductive and insulative particles therein which are used primarily for the purpose of increased abrasion resistance. The abrasion resistance characteristic is dependent upon the hardness of the insulator particles and the solids concentration of the silicates. Thus, improved abrasion resistance in the vicinity of the gun snubbers and near an antenna getter in the funnel of the cathode ray tube tends to reduce the number of abraded particles and the number of arcs occurring within an operating tube.

Normally, this group of coatings has a smaller proportion of insulative particles and lower electrical resistance than the previously mentioned "arc limiting" resistive coatings and is sometimes referred to as internal conductive coatings. However, for the purposes of this disclosure, the term resistive coatings refers to both the lower electrical resistance and the "arc limiting" type coatings.

An example of a commonly used internal resistance coating is one wherein iron oxide, graphite, a silicate solution and a dispersing agent are combined to provide a resistive coating. This coating is frequently applied to the inner surface of the cathode ray tube intermediate an anode button and a mount assembly snubber by a "brush" technique. In other words, a brush is dipped into the coating and applied to the open funnel while the open funnel is rotated prior to panel to funnel frit sealing, and prior to mount assembly sealing and exhaust or "finished" processing into a cathode ray tube.

Although the above-described technique of applying a resistive coating by a "brush" has been and still is employed with varying degrees of success, it has been found that the resultant cathode ray tube structure still has numerous deficiencies and problems. More specifically, it has been found that the capabilities for providing a uniform resistive valve for a multiplicity of cathode ray tube leaves something to be desired when the above coating and "brush" technique is utilized.

As mentioned above, the known resistive coating formulations include graphite particles therein. It has been found that at least some of the graphite particles have a tendency not to become "wetted" whereupon a graphite "screen" or "insulator-poor" portion of coating results. Moreover, that portion of the coating immediately adjacent the "insulator-poor" portion will obviously be characterized as an "insulator-rich" portion of coating.

While the above-mentioned formulations may or may not include a dispersing agent therein, it is known that a dispersing agent tends to dissolve in the aqueous solution. Thus, the dispersing agent has little or no effect upon the "wetting" of the graphite particles.

Further, it is also known that dispersing agents tend to provide an action which is electro-kinetic in nature whereby a negative charge is imported to a particle causing the particles to repel one another and thus provide the dispersing feature. Moreover, a poly-molecular layer or film is also often created when the dispersing agent is absorbed by the particle and this layer or film acts as a physical barrier to direct contact between the particle and other particles or surfaces.

Thus, a process for applying such a suspension by a "brush" technique would obviously encounter the problem of non-uniformity of the applied suspension. As a result the non-uniformity of the suspension would produce a non-uniform resistive coating with non-uniform resistive values.

Further, dispersing agents tend to form a film on the particles rather than to "wet" the particles of the suspension. In turn, the particles do not have the capability to "wet" the surface whereon the suspension is applied. Because of this lack of "wetting" action, the suspension tends to be deposited unevenly leaving undesired brush marks. Moreover, the undesired brush marks in the applied suspension dry into undesired high resistive rings in the resultant resistive coating.

OBJECTS AND SUMMARY OF THE INVENTION

An object of the present invention is to provide an improved cathode ray tube. Another object of the invention is to provide a cathode ray tube having an enhanced internal resistive coating. Still another object of the invention is to improve the uniformity of resistivity of an internal resistive coating in a cathode ray tube. A further object of the invention is to provide an internal resistive coating with enhanced uniformity of resistance and improved uniformity of application to the inner surface of a cathode ray tube. A still further object of the invention is to provide a process for making the above-described improved resistive coating.

These and other objects, advantages and capabilities are achieved in one aspect of the invention by a resistive coating derived from a suspension which includes electrically conductive particles, electrically insulative particles, silicate solids and a wetting agent of the anionic class. Also, the resistive coating is made in accordance with a method which includes the steps of mixing the electrically insulative particles, a solution of silicate solids and water to provide a mixture, milling the mixture, adding electrically conductive particles to the mixture, milling the mixture containing the electrically conductive particles to provide a homogenous suspension, preparing a stock solution of the anionic wetting agent solution, and stirring the wetting agent solution into the suspension to provide a resistive coating.

BRIEF DESCRIPTION OF THE DRAWING

The sole FIGURE is a broken-away cross-sectional view of a cathode ray tube having an internal resistive coating in accordance with the invention.

PREFERRED EMBODIMENT OF THE INVENTION

For a better understanding of the present invention, together with other and further objects, advantages and capabilities thereof, reference is made to the following disclosure and appended claims in conjunction with the accompanying drawing.

Referring to the drawing, the cathode ray tube includes an envelope 3 having a face panel portion 5, a funnel portion 7 with a neck portion 9. A seal line of glass frit 11 affixes the panel portion 5 to the funnel portion 7. The face panel portion 5 has a layer of phosphor materials 13 affixed in a pattern to the inner surface thereof with an apertured mask assembly 15 spaced from the layer of phosphor materials 13 and supported by studs 17.

The funnel portion 7 is connected to the neck portion 9 of the envelope 3 and has a high voltage anode button 19 embedded therein. A mount assembly 21 with attached snubbers 23 is sealed into the neck portion 9. A resistive coating 25 is affixed to the inner surface of the funnel and neck portions, 7 and 9 respectively, and in this example extends intermediate to and in contact with the anode button 19 and the snubbers 23. Also, an aquadag or "dag" coating 27 is affixed to the funnel portion intermediate the anode button 19 and the apertured mask assembly 15 to provided a discharge path for secondary electrons.

Alternatively, a resistive coating, such as the resistive coating 25, may extend beyond the anode button 19 to the apertured mask assembly 15. In other words, the resistive coating 25 may be applied intermediate the apertured mask assembly 15 and the snubbers 23 of the mount assembly 21. Moreover, another alternative embodiment would provide a relatively short ring-like band of resistive material 25 which is connected to the snubbers 23 of the mask assembly 21 but does not extend to the anode button 19.

Referring to the resistive coating 25, it has previously been mentioned that some graphite particles of the resistive coating suspension thend not to be "wetted" and tend to form a graphite "scum" on the surface of the solution. As a result, the "scum" tends to appear as an "insulator-poor" portion of the coating which is immediately adjacent an "insulator-rich" portion of the coating. Obviously, application of such a non-uniform suspension results in a non-uniform coating having non-uniform resistivity characteristics.

However, as is well known a wetting agent tends to lower the surface tension of water whereupon solid particles within the suspension are more readily wetted. Additionally, the wetting agent which more readily wets the solid particles also tends to improve the wetting of the inner surface of the envelope or substrate whereon the suspension is applied. Thus, the wetting agent serves as a lubricant to provide more uniformity to an applied suspension and more uniformity of resistance value of the resultant resistive coating.

More specifically, the dry resistive coating 25 appearing on the inner surface of a cathode ray tube is derived from a suspension which includes electrically conductive particles in the range of about 10–45% by weight, electrically insulative particles in the range of about 30–60% by weight, silicate solids in the range of about 20-14 45% by weight, and an alkyl aryl sulfonate wetting agent in the range of about 0.0014 to 0.014% by weight of the resistive coating. Moreover, a typical but in no way limiting, dry resistive coating includes about 42% by weight insulative particles, 38% by weight silicate solids, 20% by weight conductive particles, and 0.007% by weight alkyl aryl sulfonate.

As to materials, the electrically insulative particles are selected from a group suitable for inclusion within a cathode ray tube without deleterious effect upon the emission capabilities and extended "life" of the tube. A preferred group of electrically insulative particles consists essentially of $Fe_2O_3$, $Fe_3O_4$, and $Cr_2O_3$. Similar criteria exists for the conductive particles and a preferred conductive particle is graphite of a size less than about ten (10) microns. Also, the silicate solids must be compatible with cathode ray tube manufacture and are peferably selected from a group consisting essentially of sodium, potassium and lithium.

Importantly, the wetting agent is of the anionic class which includes alcohol sulfates, alcohol ether sulfates, alcohol phosphates, aliphatic sulfonates and alkyl-aryl sulfonates. Specifically, a preferred wetting agent is an alkyl aryl sulfonate which may be represented by the following general formula:

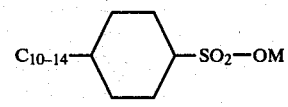

where M is selected from the group consisting of sodium, potassium and lithium

Also, a preferred commercially available wetting agent is known as Alkanol WXN manufactured by the Dupont Company of Wilmington, Delaware. Another similar and suitable wetting agent is commercially available under the tradename of Cal Soft L-40 manufactured by the Pilot Chemical Company of Los Angeles, California. Moreover, the Alkanol WXN is readily available as a solution which includes about 30% by weight of alkyl aryl sulfonate while the Cal Soft L-40 includes about 40% by weight of alkyl aryl sulfonate.

As to a method of making the above-mentioned resistive coating, the following ingredients, which are typical but in no way to be construed as limiting, may be utilized to provide a resistive coating. About 75.6 grams of $Fe_2O_3$ (powder) is mixed with about 114.0 grams of sodium silicate solution having about 54% by weight of silicate solids and about 99 grams of water to provide a mixture. This mixture is ball milled in a porcelain cylinder for about one-hour to insure thorough mixing of the ingredients.

Thereafter, conductive particles are added to the mixture. Preferably, a commercially available product is utilized to provide the desired conductive particles. A preferred commercial product, available from Pierce and Stevens Company of Buffalo, New York, is known as Pierce and Stevens A-7381AH, which includes approximately 4.9% by weight of sodium silicate solids, 27.4% by weight of graphite particles and 67.7% by weight of water. Moreover, about 131.2 grams of the Pierce and Stevens A-7381AH is added to the above-described mixture.

Following, the mixture with the included conductive particles is ball-milled for about two (2) hours to insure a uniform suspension of materials. A stock solution of wetting agent is prepared by diluting 1-part of the above-mentioned Alkanol WXN with 99-parts of deionized water. It should be noted that the Alkanol WXN is a 30% by weight solution of alkyl aryl sulfonate.

Thereafter, about 1.0 grams of wetting agent stock solution is added, by stirring, to each 100-grams of suspension provide an enhanced resistive suspension. This suspension is applied, by brushing or other appropriate means to the inner surface of the funnel portion of the cathode ray tube to provide the desired resistive coating.

As an example of the improved uniformity of resistance obtainable with the above-described improved resistive coating the following comparison was made:

| | Test No. | Formulation | Coating Resis. (19" funnels) |
|---|---|---|---|
| Control | 770927-4 | 38% silicate Solids | 9,200 ohms |
| | 770927-5 | 42% $Fe_2O_3$ 20% graphite | 85,000 ohms |
| Test | 770926-2 | Same as above except | 9,100 ohms |
| | 770926-3 | 0.01% Alkanol WXN added | 6,900 ohms |

As can readily be seen, the resistivity values of the "control," which does not include a wetting agent, have a relatively wide variation. On the otherhand, the "Test," which includes the above-mentioned wetting agent, shows a much smaller spread of resistivity values from tube to tube. Therefore, one could reasonably conclude that uniformity of resistivity of the coating is enhanced by the addition of a wetting agent of the alkyl aryl sulfonate group.

Thus, there has been provided a unique resistive coating for the inner surface of a cathode ray tube. This improved resistance coating exhibits an enhanced uniformity of resistance due to the enhanced "wetting" capabilities of the formulation. Moreover, this enhanced "wetting" capability also contributes to the uniformity of application of the coating to the cathode ray tube envelope surface whereupon resistance uniformity of the coating is further improved.

Additionally, the improved resistance cotaing is made by a method whereby the added "wetting" feature enhances the mixing capabilities of the solutions thereby virtually eliminating undesired "insulator-rich" and "insulator-poor" regions of the suspension. As a result, the suspension is applied to the cathode ray tube inner surface with a uniformity which, in so far as is known, was previously unattainable.

While there has been shown and described what is at present considered the preferred embodiments of the invention, it will be obvious to those skilled in the art that various changes and modifications may be made therein without departing from the invention as defined by the appended claims.

What is claimed is:

1. In a cathode ray tube having an envelope with an apertured mask assembly therein and interconnected funnel and neck portions wherein the funnel portion has an anode button sealed therein and the neck portion has a mount assembly with affixed snubbers sealed therein, an improved resistive coating disposed on the internal surface of said envelope and contacting said snubbers of said mount assembly, said resistive coating derived from a suspension consisting essentially of electrically conductive and insulative particles, silicate solids and an anionic wetting agent, sand conductive particles being in the range of about 10–45% by weight, said insulative particles in the range of about 30–60% of weight, said silicate solids in the range of about 20–45% by weight and said anionic wetting agent being an alkyl sulfonate in the range of about 0.0014 to 0.014% by weight of said coating.

2. The improved resistive coating of claim 1 wherein said anionic wetting agent is in the form of an alkyl aryl sulfonate wetting agent represented by the formula:

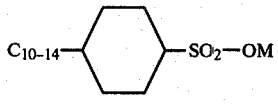

where M is selected from the group consisting essentially of sodium, potassium and lithium.

3. The improved resistive coating of claim 1 wherein said electrically insulative particles are selected from the group consisting essentially of $Fe_2O_3$, $Fe_3O_4$ and $Cr_2O_3$.

4. The improved resistive coating of claim 1 wherein said electrically conductive particles are in the form of graphite in the range of about 10–45% by weight, said electrically insulative particles are in the form of $Fe_2O_3$ in the range of about 30–60% by weight, said silicate solids are in the forms of sodium silicate in the range of about 20–45% by weight and said wetting agent is in the form of an alkyl aryl sulfonate in the range of about 0.0014 to 0.014% by weight of said resistive coating.

5. The improved resistive coating of claim 1 wherein said resistive coating extends from said snubbers to said anode button sealed in said funnel portion of said cathode ray tube.

6. The improved resistive coating of claim 1 wherein said resistive coating extends from said snubbers to said apertured mask assembly in said envelope.

* * * * *